US011414801B2

(12) United States Patent
Park et al.

(10) Patent No.: US 11,414,801 B2
(45) Date of Patent: Aug. 16, 2022

(54) DRUM WASHING MACHINE

(71) Applicant: SAMSUNG ELECTRONICS CO., LTD., Suwon-si (KR)

(72) Inventors: Dae Wook Park, Hwaseong-si (KR); Dong Woo Lee, Yongin-si (KR); Valeriy Prushinskiy, Hwaseong-si (KR); Igor Ivanov, Suwon-si (KR); Hyung Sok Yeo, Hwaseong-si (KR); Jun Young Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 416 days.

(21) Appl. No.: 16/327,931

(22) PCT Filed: Jul. 24, 2017

(86) PCT No.: PCT/KR2017/007941
§ 371 (c)(1),
(2) Date: Feb. 25, 2019

(87) PCT Pub. No.: WO2018/038405
PCT Pub. Date: Mar. 1, 2018

(65) Prior Publication Data

US 2019/0186062 A1 Jun. 20, 2019

(30) Foreign Application Priority Data

Aug. 25, 2016 (KR) ..... 10-2016-0108065

(51) Int. Cl.
*D06F 31/00* (2006.01)
*D06F 37/40* (2006.01)
(Continued)

(52) U.S. Cl.
CPC ..... *D06F 31/00* (2013.01); *D06F 37/28* (2013.01); *D06F 37/40* (2013.01); *D06F 17/08* (2013.01);
(Continued)

(58) Field of Classification Search
CPC ..... D06F 31/00; D06F 37/40; D06F 37/28; D06F 17/08; D06F 37/30; D06F 39/14; D06F 37/06; D06F 29/00
See application file for complete search history.

(56) References Cited

U.S. PATENT DOCUMENTS 3,696,521 A 10/1972 Hubbard
5,784,901 A 7/1998 Yanase et al.
(Continued)

FOREIGN PATENT DOCUMENTS

CN 101314905 12/2008
CN 103572547 A 2/2014
(Continued)

OTHER PUBLICATIONS

Chinese Office Action dated May 24, 2021 from Chinese Application No. 201780052127.X.
(Continued)

*Primary Examiner* — Benjamin L Osterhout
(74) *Attorney, Agent, or Firm* — Staas & Halsey LLP

(57) ABSTRACT

A washing machine comprises a housing including a main inlet on a front surface thereof, a main washing unit disposed in the housing, a main door opening and closing the inlet, and a sub-washing unit disposed in the main door and provided with a pulsator. A large amount of laundry can be washed through the main washing unit and a small amount of laundry can be washed through the sub-washing unit, so that washing can be efficiently performed according to the amount of laundry.

5 Claims, 6 Drawing Sheets

(51) Int. Cl.

| | |
|---|---|
| ***D06F 37/28*** | (2006.01) |
| *D06F 37/06* | (2006.01) |
| *D06F 37/30* | (2020.01) |
| *D06F 39/14* | (2006.01) |
| *D06F 29/00* | (2006.01) |
| *D06F 17/08* | (2006.01) |

(52) U.S. Cl.
CPC ..... *D06F 29/00* (2013.01); *D06F 37/06* (2013.01); *D06F 37/30* (2013.01); *D06F 39/14* (2013.01)

(56) References Cited

U.S. PATENT DOCUMENTS

| | | | | |
|---|---|---|---|---|
| 2015/0292135 | A1* | 10/2015 | Wish | D06F 39/14 68/139 |
| 2018/0073178 | A1* | 3/2018 | Wishney | D06F 39/14 |

FOREIGN PATENT DOCUMENTS

| | | |
|---|---|---|
| KR | 10-1997-0043502 | 7/1997 |
| KR | 10-0146934 | 10/1998 |
| KR | 10-2003-0033689 | 5/2003 |
| KR | 10-2015-0118230 | 10/2015 |

OTHER PUBLICATIONS

Extended European Search Report dated Jun. 14, 2019 in corresponding European Patent Application No. 17843825.5.
Chinese Office Action dated Oct. 9, 2020 from Chinese Application No. 201780052127.X, 25 pages.
International Search Report dated Oct. 31, 2017 in International Patent Application No. PCT/KR2017/007941.
Written Opinion of the International Searching Authority dated Sep. 22, 2017 in International Patent Application No. PCT/KR2017/007941.

* cited by examiner

DRUM WASHING MACHINE

CROSS-REFERENCE TO RELATED APPLICATIONS

This application is a U.S. National Stage Application which claims the benefit under 35 U.S.C. § 371 of International Patent Application No. PCT/KR2017/007941 filed on Jul. 24, 2017, which claims foreign priority benefit under 35 U.S.C. § 119 of Korean Patent Application No. 10-2016-0108065 filed on Aug. 25, 2016 in the Korean Intellectual Property Office, the contents of both of which are incorporated herein by reference.

TECHNICAL FIELD

The present disclosure relates to a washing machine capable of efficiently washing a small amount of laundry.

BACKGROUND ART

In general, a washing machine is an apparatus including a water tub and a rotating tub which is rotatably installed in a water tub. The rotating tub containing laundry is rotated in the tub to wash the laundry.

Recently, in such a washing machine, there is a drum washing machine having a cylindrical rotating tub which is arranged in a substantially horizontal direction so that the laundry is pulled upward and then dropped down in accordance with a rotation of the rotating tub, thereby the laundry is washed by a head drop.

In addition, in such the washing machine, the rotating tub is formed to have a size larger than a predetermined size so as to wash a large laundry such as a comforter. Therefore, even when washing only a small amount of laundry, water and electricity are used more than necessary.

DISCLOSURE

Technical Problem

The present disclosure is directed to providing a washing machine capable of efficiently washing not only a large amount of laundry but also a small amount of laundry.

Technical Solution

One aspect of the present disclosure provides a washing machine including a housing having a main inlet on a front surface thereof, a main washing unit disposed in the housing, a main door to open and close the main inlet; and a sub-washing unit disposed at the main door, wherein the sub-washing unit includes a sub-water tub to store water, a pulsator rotatably installed in the sub-water tub and a sub-driving motor to rotate the pulsator.

The main washing unit may include a main water tub to store water and a main rotating tub rotatably installed in the main water tub, and the main washing tub and the main rotating tub may include an opening provided toward the main inlet, respectively.

The sub-washing unit may further include a sub-rotating tub rotatably installed in the sub-water tub, and the pulsator may be disposed in the sub-rotating tub.

A lower end of the main door may be rotatably installed on the housing.

The main door may include a sub-inlet provided on a rear surface thereof, and the sub-water tub and the sub-rotating tub may include an opening opened toward the sub-inlet.

The sub-water tub may include an opening opened upward.

The pulsator may be disposed in an inner lower portion of the sub-water tub.

The main door may include a sub-inlet provided at an upper portion of a front surface thereof, a discharge port provided at a lower portion of a rear surface thereof, a sub-door to open and close the sub-inlet and a discharge port door to open and close the discharge port.

The sub-washing unit may further include a sub-rotating tub rotatably installed in the sub-water tub and provided with a pulsator disposed in an inner lower portion of the sub-rotating tub.

The main door may further include a sub-inlet provided at an upper portion of a front surface of the main door.

One side of the main door may be rotatably installed at the housing and rotates left and right to open and close the main inlet.

Another aspect of the present disclosure provides a washing machine including a housing having an inlet, a main door to open and close the inlet, a main washing unit disposed in the housing, and a sub-washing unit disposed at the main door.

The main inlet may be provided on an upper surface of the housing.

Advantageous Effects

As is apparent from the above, the washing machine according to one aspect of the present disclosure is capable of washing a large amount of laundry through the main water tub and the main rotating tub installed in the housing, and washing a small amount of laundry through the sub-washing unit installed in the main door so that a large amount of laundry and a small amount of laundry can be efficiently washed.

MODES OF THE INVENTION

A washing machine according to a first embodiment of the present disclosure will be described in detail with reference to the figures.

In the embodiment, a drum washing machine will be described as an example.

Figure 1:
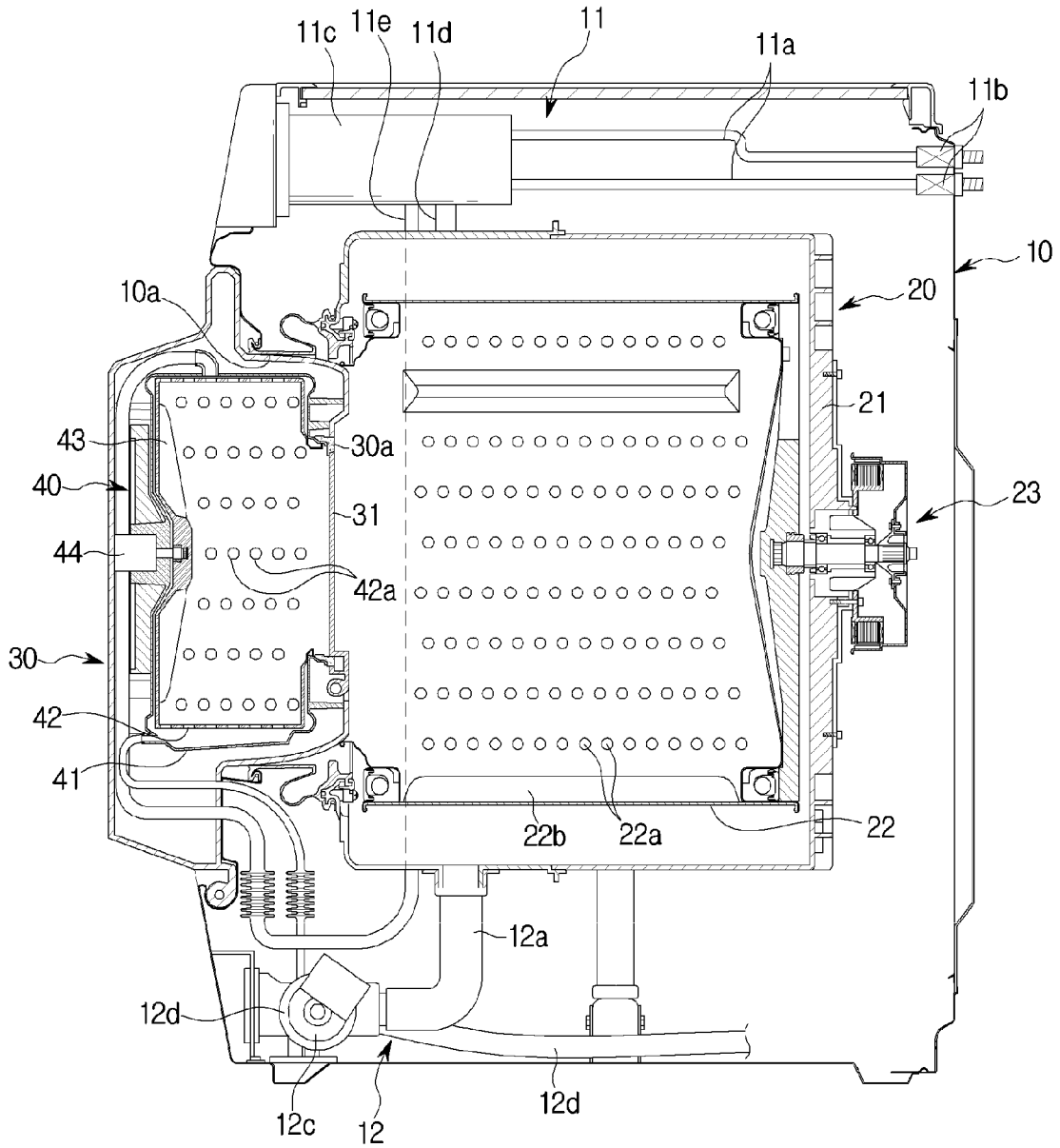
FIG. 1 is a schematic view illustrating a washing machine according to a first embodiment of the present disclosure.

Referring to FIG. 1, a washing machine according to a first embodiment of the present disclosure includes a housing 10 forming an outer appearance of the washing machine and a main washing unit 20 disposed in the housing 10 to wash a large amount of laundry.

The main washing unit 20 includes a main water tub 21 provided in the housing 10 to store water and a main rotating tub 22 rotatably installed in the main water tub 21 and a main drive motor 23 to generate a rotational force and rotate the main rotating tub 22.

The housing 10 includes a main inlet 10*a* provided in a front surface thereof to guide the laundry into the main rotatable tub 22 inside the housing.

A water supply device 11 to supply water for washing is disposed at an inner upper portion of the housing 10. A drain device 12 to discharge water used for washing to an outside is disposed at an inner lower portion of the housing 10.

The water supply device 11 includes a water supply pipe 11*a* connected to an external water source, a water supply valve 11*b* disposed at the water supply pipe 11*a* to open and close the water supply pipe 11*a* and washing water supply pipes 11*d* and 11*e* for guiding the water and detergent of a detergent supply device 11*c* to the main water tub 20 and a sub-water tub 41. The washing water supply pipes 11*d* and 11*e* include a main wash water supply pipe 11*d* connected to the main water tub 21 and a sub-wash water supply pipe 11*e* connected to the sub-water tub 41.

The drain device 12 includes drain pipes 12*a* and 12*b* for guiding the wash water used in the main water tub 21 and the sub-water tub 41 to be discharged to an outside of the washing machine, a drain pump 12*c* to suction and discharge the washing water, and a drain hose 12*d* for guiding the wash water discharged from the drain pump 12*c* to the outside of the housing 10. The drain pipes 12*a* and 12*b* include a main drain pipe 12*a* connected to the main water tub 21 and a sub-drain pipe 12*b* connected to the sub-water tub 41.

A main door 30 to open and close the main inlet 10*a* is rotatably installed on the front surface of the housing 10. In the embodiment, a lower end of the main door 30 is rotatably installed on the front surface of the housing 10, and thus the main door 30 rotates around the lower end to open and close the main inlet 10*a*.

The main water tub 21 and the main rotating tub 22 are formed in a hollow cylindrical shape and have an opening at one side in the axial direction thereof, and the openings of the main tub 21 and the main rotating tub 22 are provided toward the main inlet 10*a*, respectively.

The main rotating tub 22 has a plurality of through holes 22*a* provided on an outer circumferential surface thereof so as to allow water to pass therethrough and a plurality of lifters 22*b* provided on an inner circumferential surface thereof and circumferentially spaced apart from each other to pull up the laundry.

The main driving motor 23 is installed on the rear surface of the main water tub 21. A driving shaft of the main driving motor 23 penetrates the main water tub 21 and is coupled to a center of a rear surface of the main rotating tub 22.

The drum washing machine further includes a sub-washing unit 40 installed at the main door 30 to wash a small amount of the laundry.

The main door 30 includes a sub-inlet 30*a* provided on the rear surface (when the main door 30 closes the main inlet 10*a*.) thereof for allowing the laundry to be inserted into the sub-washing unit 40 and a sub-door 31 rotatably installed on the rear surface of the main door 30 to open and close the sub-inlet 30*a*.

The sub-washing unit 40 includes a sub-water tub 41 to store water, a sub-rotating tub 42 rotatably installed in the sub-water tub 41, a pulsator 43 installed in the sub-rotating tub 42 to generate a water stream and a sub-drive motor 44 to generate a rotational force for rotating the pulsator 43 and the sub-rotating tub 42.

The sub-water tub 41 and the sub-rotating tub 42 are formed in a cylindrical shape having an opening at one side in the axial direction, and the openings of the sub-water tub 41 and the sub-rotating tub 42 are provided toward the sub-inlet 30*a* provided on a rear surface of the main door 30.

The sub-rotating tub 42 has through holes 42*a* provided on an outer circumferential surface thereof like the main rotating tub 22 so that the sub-washing unit 40 may perform dehydration.

In the embodiment, the sub-inlet 30*a* is provided on the rear surface of the main door 30 and openings of the sub-water tub 41 and the sub-rotating tub 42 are arranged to face a rear side. Also, the pulsator 43 is disposed at an inner front portion of the closed sub-rotating tub 42.

Figure 2:
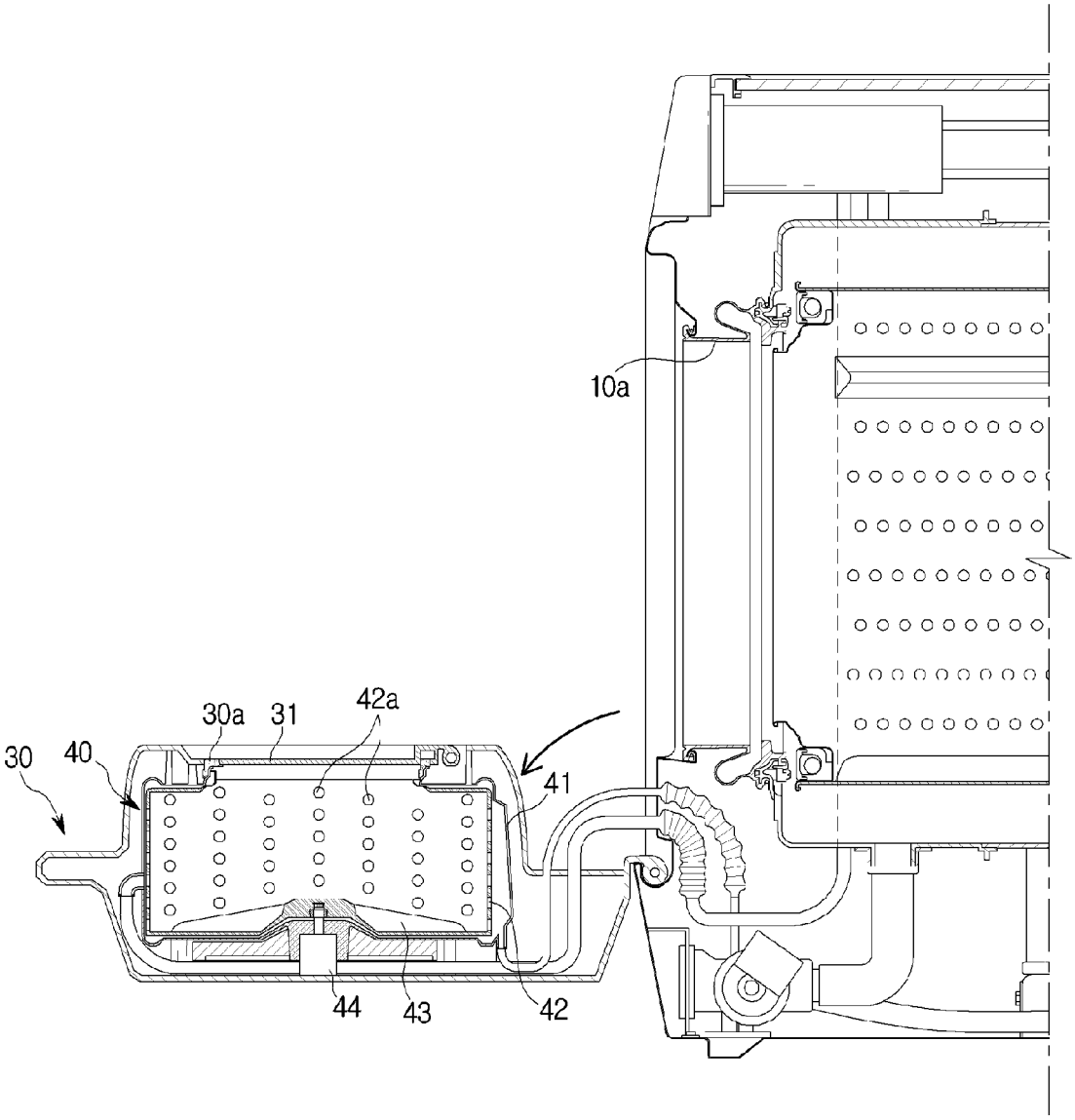
FIG. 2 is a schematic view illustrating a state in which a main door is opened in the washing machine according to the first embodiment of the present disclosure.

Referring to FIG. 2, when a small amount of the laundry is washed by the sub-washing unit 40, the main door 30 is rotated so that the main door 30 is substantially horizontal with a floor.

Figure 3:
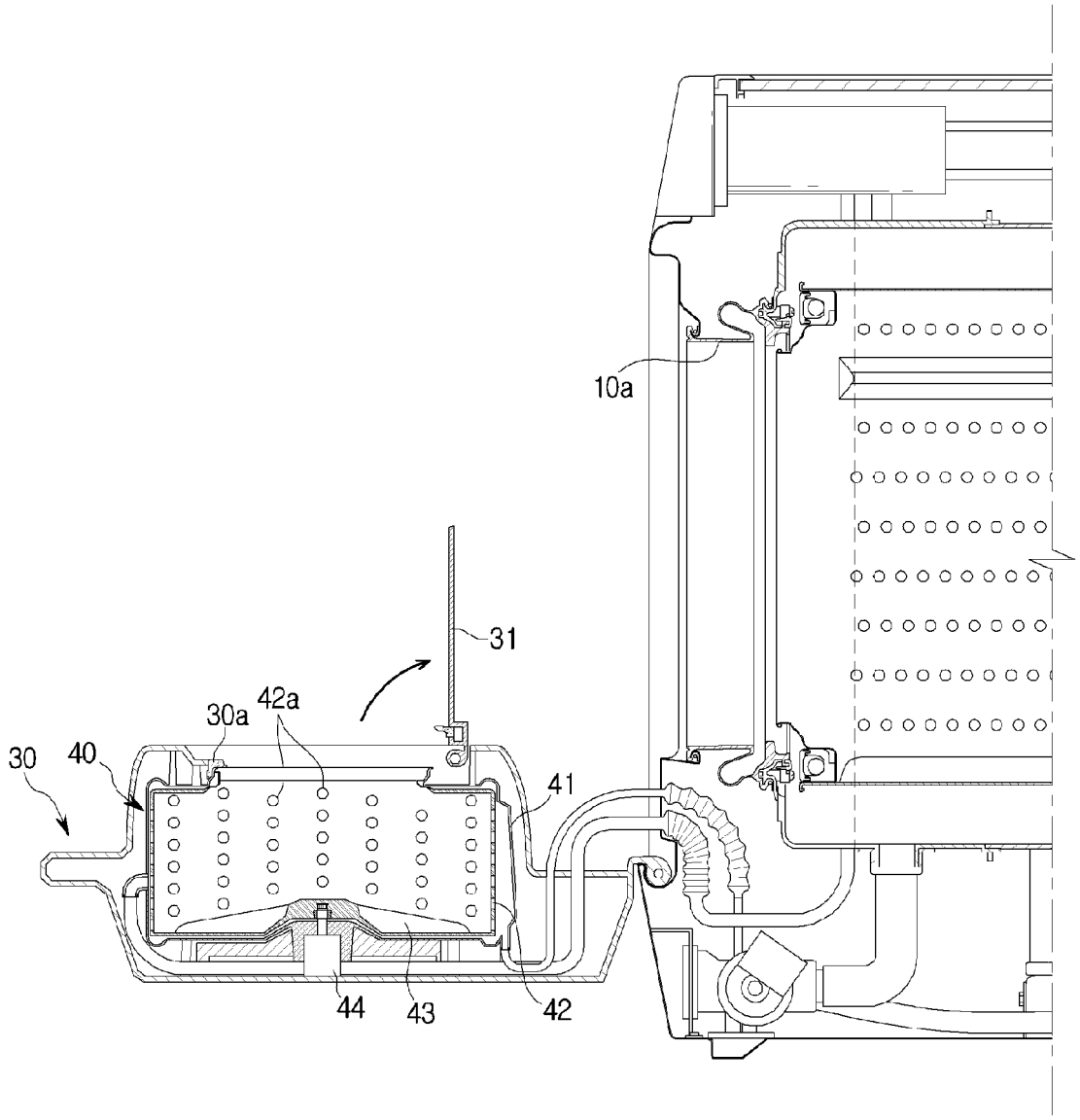
FIG. 3 is a schematic view illustrating a state in which the main door and a sub-door are opened in the washing machine according to the first embodiment of the present disclosure.

In such a state, the openings of the sub-water tub 41 and the sub-rotating tub 42 open upward. Referring to FIG. 3, when the sub-door 31 is rotated to open the sub-inlet 30*a*, the laundry may be introduced into the sub-rotating tub 42 through the sub-inlet 30*a* and to perform washing.

Accordingly, when a large amount of the laundry is to be washed, the laundry may be inserted to the main rotating tub 22 to perform washing. When a small amount of the laundry is to be washed, the laundry may be inserted into the rotating tub 42 to perform washing. Therefore, the small amount of the laundry may be efficiently washed by using a small amount of water and electricity.

In the above embodiment of the present disclosure, the sub-washing unit 40 includes the sub-water tub 41, the sub-rotating tub 42 and the pulsator 43 so that the sub-washing unit 40 performs washing and dehydration. However, the present disclosure is not limited thereto.

Figure 4:
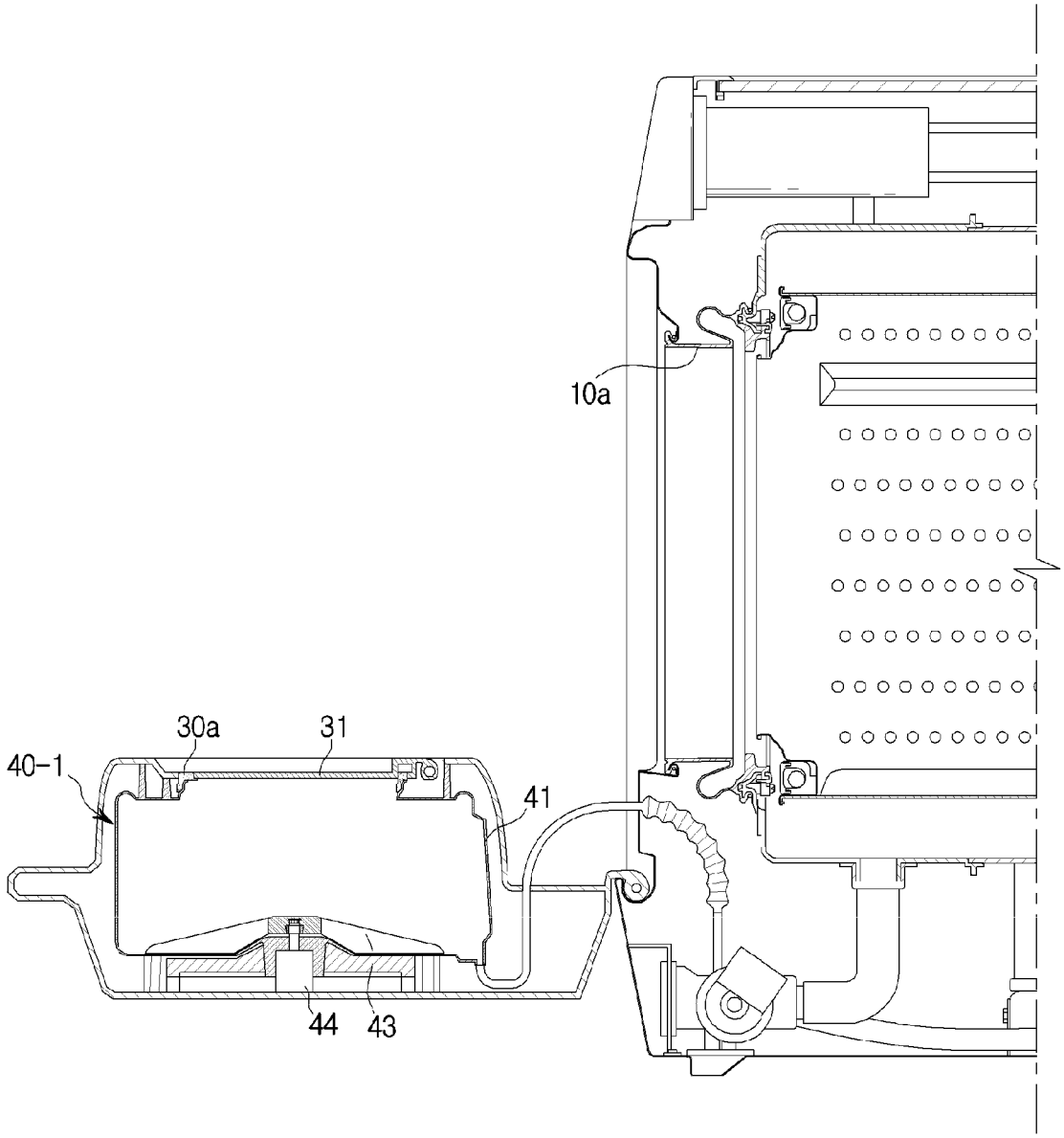
FIG. 4 is a schematic view illustrating a sub-washing unit applied to a washing machine according to a second embodiment of the present disclosure.

FIG. 4 illustrates a sub-washing unit 40-1 according to a second embodiment of the present disclosure. The sub-washing unit 40-1 is disposed at a main door 30 and includes a sub-water tub 41 to store water and a pulsator 43 rotatably installed in the sub-water tub 41. That is, the sub-washing unit 40-1 according to the second embodiment of the present disclosure doesn't have a configuration corresponding to a sub-rotating tub, so that the sub-washing unit 40-1 performs washing only.

When the sub-washing unit 40-1 is configured without the sub-rotating tub, it is easier to secure a space for accommodating laundry and thus a large amount of the laundry may be washed through the sub-washing unit 40.

In the above first embodiment of the present disclosure, the sub-washing tub 40 is provided such that the sub-water tub 41 and the sub-rotating tub 42 are provide to face the sub-inlet 30*a* provided on the rear surface of the main door 30, but the present disclosure is not limited thereto.

Figure 5:
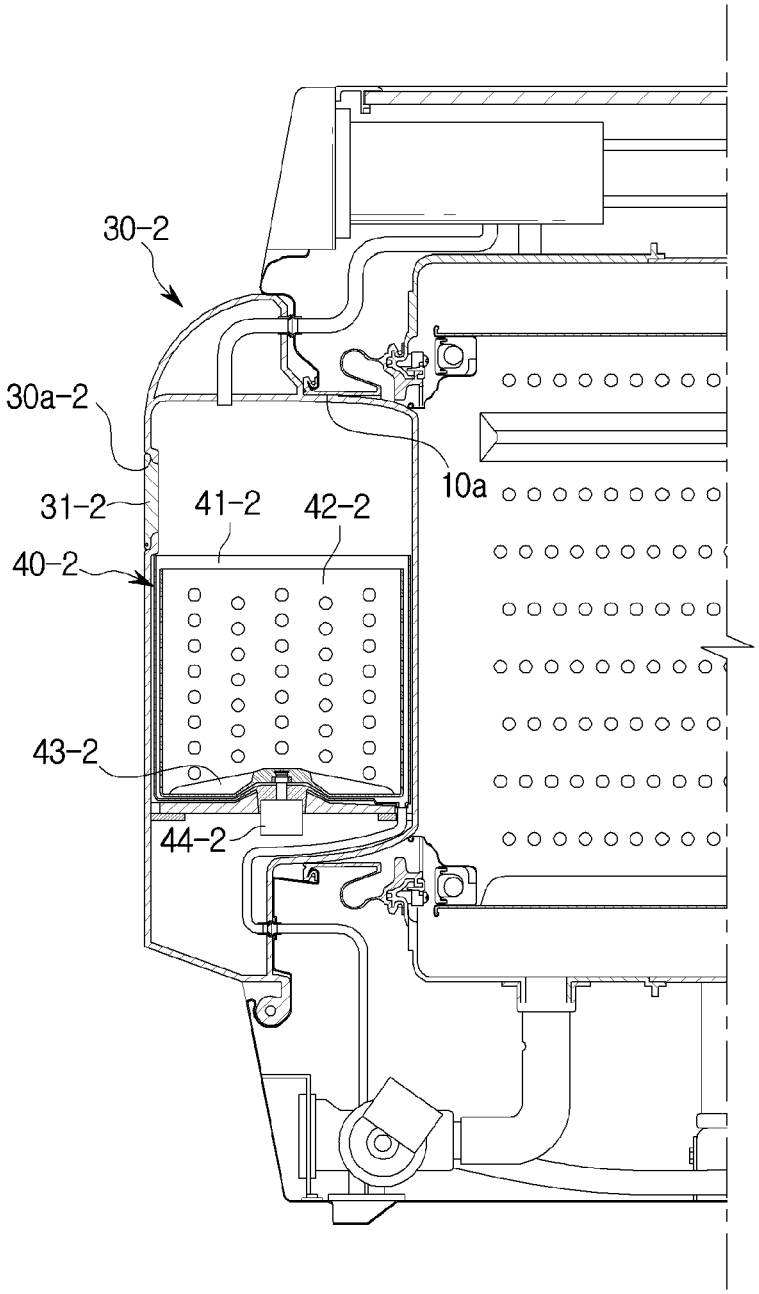
FIG. 5 is a schematic view illustrating a sub-washing unit applied to a washing machine according to a third embodiment of the present disclosure.

FIG. 5 illustrates a sub-washing unit 40-2 according to the third embodiment of the present disclosure. The sub-washing unit 40-2 includes a sub-water tub 41-2 to store water, a sub-rotating tub 42-2 having a cylindrical shape rotatably installed in the sub-water tub 41-2 and having an opening on an upper side thereof, a pulsator 43-2 rotatably installed on an inner lower portion of the sub-rotating tub 42-2 to generate a water stream, and a sub-driving motor 44-2 to rotate the sub-rotating tub 42-2 and pulsator 43-2.

The main door 30-2 has a sub-inlet 30*a*-2 provided at an upper portion of the front surface of the main door 30-2 so that a user may insert laundry into the sub-rotating tub 42-2 or take out washed the laundry from the sub-rotating tub 42-2, and a sub door 31-2 to open and close the sub inlet 30*a*-2. In the embodiment, one side of the main door 30-2 is rotatably installed in the housing 10 and rotates left and right to open and close the main inlet 10*a*.

When the opening of the sub-rotating tub 42-2 is disposed upward, the laundry may be washed and dehydrated without opening the main inlet 10*a*. In addition, the washing may be performed in a state in which the main inlet 10*a* is closed. Therefore, washing and dehydrating of the sub-washing unit 40-2 and washing and dehydrating of the main washing unit 20 can be performed at the same time.

In the above third embodiment, the sub-washing unit 40-2 includes the sub-tub 41-2, the sub-rotating tub 42-2, the pulsator 43-2 and a sub-driving motor 44-2 so that the sub-washing unit 40-2 may perform washing and dehydration, but the present disclosure is not limited thereto.

Figure 6:
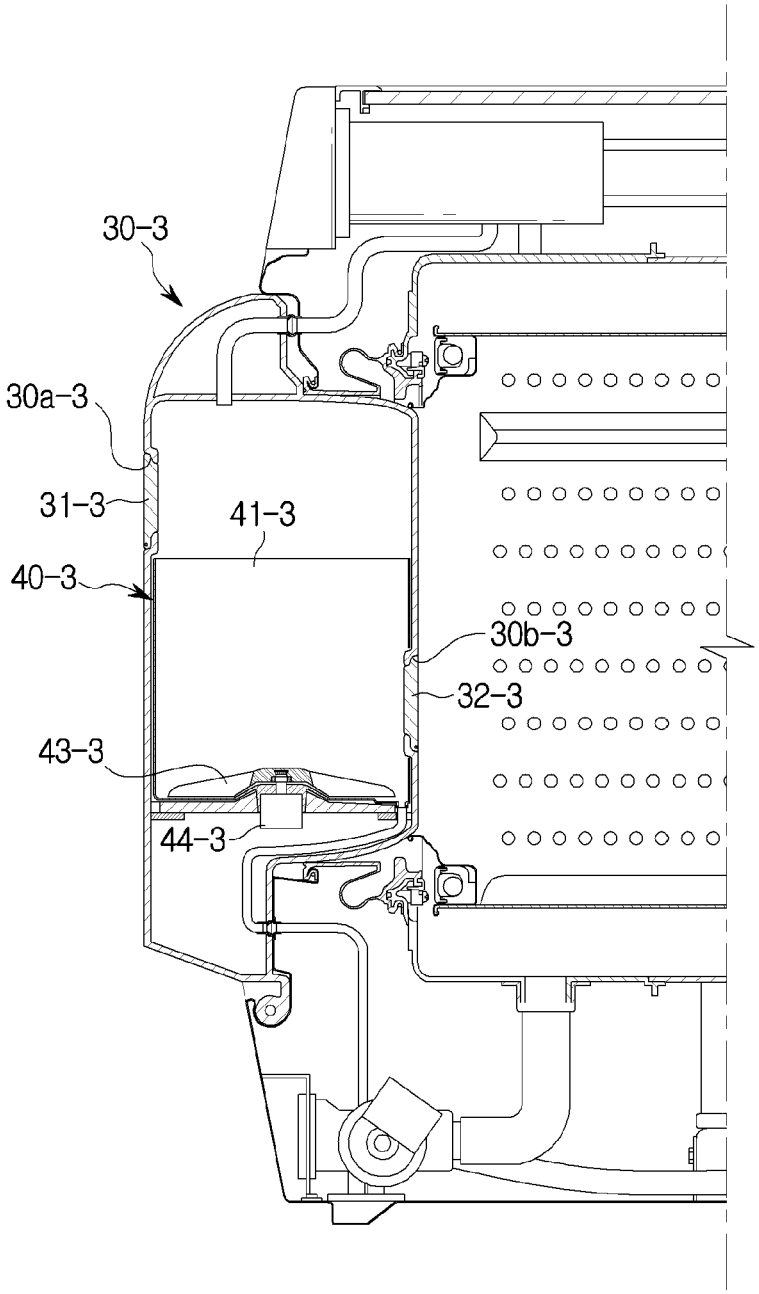
FIG. 6 is a schematic view illustrating a sub-washing unit applied to a washing machine according to a fourth embodiment of the present disclosure.

FIG. 6 illustrates a sub-washing unit 40-3 according to a fourth embodiment of the present disclosure. The sub-washing unit 40-3 disposed at a main door 30-3 includes a sub-water tub 41-3 to store water and a pulsator (44-3) installed rotatably in an inner lower portion of the sub-water tub 41-3 and a sub-drive motor 44-3. That is, in the sub-washing unit 40-3 according to the fourth embodiment of the present disclosure, the sub-washing unit 40-3 does not have a configuration corresponding to a sub-rotating tub. Therefore, the sub-washing unit 40-3 performs washing only.

The main door 30-3 has a sub-inlet 30*a*-3 provided at an upper portion of a front surface thereof to enable a user to insert laundry into the sub-rotating tub 42-3, and a sub-door 31-3 to open and close the sub-inlet 30*a*-3, a discharge port 30*b*-3 provided at a lower portion of the rear surface thereof to discharge the washed laundry to the main rotating tub 21, and a discharge port door 32-3 to open and close the discharge port 30*b*-3.

When the sub-washing unit 40 is configured without the sub-rotating tub 42, a space for accommodating the laundry may be easily secured and a larger amount of the laundry may be washed through the sub-washing unit 40.

In the above embodiments, the main door 30 is to open and close the main inlet 10*a* provided on the front surface of the housing 10, but this is only an example. Even when a main door opens or closes a main inlet provided on an upper surface of a housing, a sub-washing unit may be disposed at the main door.

While the present disclosure has been particularly described with reference to exemplary embodiments, it should be understood by those of skilled in the art that various changes in form and details may be made without departing from the spirit and scope of the present disclosure.

The invention claimed is:

1. A drum washing machine comprising:

a housing comprising a main inlet on a surface thereof;

a main washing unit disposed in the housing;

a main door to open and close the main inlet, the main door having a front surface facing outside the drum washing machine and a rear surface having a sub-door therein; and a sub-washing unit in the main door, the sub-washing unit including a sub-water tub to store water, a pulsator rotatably installed in the sub-water tub and a sub-driving motor to rotate the pulsator, the sub-water tub having a sub-opening facing the sub-door, the pulsator being disposed at an inner front portion of the main door.

2. The drum washing machine according to claim 1, wherein the main washing unit comprises a main water tub to store water and a main rotating tub rotatably installed in the main water tub, and the main washing tub and the main rotating tub comprise an opening provided toward the main inlet, respectively.

3. The washing machine according to claim 1, wherein the sub-washing unit further comprises a sub-rotating tub rotatably installed in the sub-water tub; and the pulsator is disposed in the sub-rotating tub.

4. The washing machine according to claim 1, wherein a lower end of the main door is rotatably installed on the housing.

5. The washing machine according to claim 4, wherein the sub-rotating tub comprises an opening toward the sub-inlet.

* * * * *